United States Patent [19]

Treugut et al.

[11] 3,963,242

[45] June 15, 1976

[54] CHESS GAME FOR THREE PEOPLE

[75] Inventors: Andreas Treugut, Rothenbach; Jurgen Bottcher, Nurnberg, both of Germany

[73] Assignee: Modell-System-Beratung Dietmar Stegmann, Heinrich Koller, Nurnberg, Germany

[22] Filed: Feb. 10, 1975

[21] Appl. No.: 548,870

[30] Foreign Application Priority Data

Feb. 11, 1974 Germany ..... 2406462

[52] U.S. Cl. ..... 273/131 L; 273/131 F; 273/131 KN

[51] Int. Cl.[2] ..... A63F 3/02

[58] Field of Search ..... 273/131, 137

[56] References Cited

UNITED STATES PATENTS

| | | | |
|---|---|---|---|
| 3,341,205 | 9/1967 | Dykes | 273/131 L |
| 3,533,627 | 10/1970 | Deffenbaugh et al. | 273/131 L |
| 3,652,091 | 3/1972 | Zubrin | 273/131 B |
| 3,778,065 | 12/1973 | Hale | 273/131 AB |
| 3,836,149 | 9/1974 | Adams et al. | 273/131 AB |

FOREIGN PATENTS OR APPLICATIONS

| | | | |
|---|---|---|---|
| 3,214 | 1902 | United Kingdom | 273/131 L |
| 1,092,860 | 11/1967 | United Kingdom | 273/131 AB |

*Primary Examiner*—Delbert B. Lowe
*Attorney, Agent, or Firm*—Haseltine, Lake & Waters

[57] ABSTRACT

A chess game is provided having a hexagonal board having alternate sides constituting bases for respective of three participants. Polygonal fields are provided on the board in the form of triangles, quadrilaterals or hexagons. These fields extend between the three bases and occupy at least substantially all of the board. Three like sets of men correspond to the bases, and include a king, queen, two bishops, two castles, two knights, a plurality of pawns and a cardinal, which is still movable after the corresponding king is checkmated. There may be provided an extra pawn in each set, and there may also be provided an identifying field or ring to place under or encircle a checkmated king. The cardinal and queen are entitled to similar moves. The cardinal may not conquer men from sets of other participants. The cardinal has social-political characteristics, and it is arranged that this man can be conquered only under difficult circumstances or not at all. It has the quality of political fight without the use of force.

5 Claims, 5 Drawing Figures

CHESS GAME FOR THREE PEOPLE

FIELD OF THE INVENTION

This invention relates to chess boards for three people and more particularly to chess games with symmetrical boards and corresponding triangular or polygonal fields.

BACKGROUND

Three-man chess boards are known which allow temporary participation of three instead of two parties. One of these is disclosed in the newspaper "Die Zeit" No. 15 of Apr. 6, 1973, page 71. Another is disclosed in the magazine "Stern" No. 46 of November, 1973, page 93.

If, in the above games, the king of one party is checkmated, this party is eliminated and the game becomes a game for two parties. This creates a disturbing change in the game and an unbalanced situation, as the remaining chess-men of the eliminated party can be used by the checkmating party or remain on the field as unmoving obstacles, or are moved from the board altogether.

In one of the known games, the positioning of the square and oblique angled quadrangles causes a transition problem from the starting point of the one party to the starting point of the other. Those must be eliminated with transit fields and additional rules for moves which are valid only in these transit fields.

The other known game avoids transit fields. However, as six oblique angles quadrangles collide in the center of the board, the homogeneity of the rules of movement is interrupted.

If one defines the "degree of freedom Fr." of movement of a chessman as a relation between the number of possible moves L and the number of parties S, then the queen in the two-man chess game represents a value Fr. = L/S = 4/2 = 2 and the queen of the previously mentioned three-man chess game has a value of: Fr. = L/S = 4/3 = 1.33. The degree of freedom of all of the chess men of these games is thus lower by ⅓. Therefore the situation for one party, who is being pressed by the other two participants, soon becomes hopeless, as his chess men find no protection and as there are no additional escape facilities on the normal squares.

There are also three-man chess boards with triangular fields (German Patents Nos. 14484 and 24253), one of which divides the squares into two triangular fields and consequently does not allow the positioning of both parties with equal chances. In the other game with fields of equilateral triangles, which positions eight chess men in one row, the geometry of the fields causes an asymmetrical starting position for the chess men and uneven starting chances for corresponding chess men such as, e.g., the right and left castles.

SUMMARY OF THE INVENTION

It is an object of this invention to provide, from a conventional game of chess for two people, a social chess game in which the symbolism pertaining to chess is amalgamated with the characteristics of a social game, this being expressed in the entire method of play without there being fundamental changes to the known moves of the two-man chess game and without neglecting the parity of chances between the parties, the social game being extended from two to at least three participants.

The objects of this invention, which aim at avoiding the disadvantages of known three-man chess games as described above, are achieved on one chess board with triangular or polygonal fields, each participant having an equal or varying number of known chess men as in the known two-man chess game, by providing each of the three participants with at least one additional chess man which has social-political status which is given by the combination of one or more of the following characteristics: the quality of saving games, insofar as a participant whose king has been checkmated can continue with this chess man; a quality of protection, as this chess man can be beaten only under extremely difficult circumstances or not at all, or the quality of political fight without the use of force as this chess man cannot conquer others, or the quality of fast, tactical movement, as it can move like a queen.

According to the symbolism of this additional man, the qualities of this new chess man can be interpreted symbolically as a court jester, due to its great freedom of movement and its virtual invincibility, symbolically as a chancellor due to its quality of political fight without force, and symbolically as a cardinal for its acts of protection and politics.

DETAILED DESCRIPTION

In the following explanation, the new chess man of the invention will be referred to as a cardinal. According to the invention, the introduction of the cardinal and its qualities into a three-man chess game creates the following advantages: all three participants actively take part in the game up to the mutual ending and the participant attacked contemporaneously by the two opposing participants has greater possibilities of protection. Capabilities of social negotiations, treaties and intrigues are symbolized on an equal basis according to the use of known chess men.

Figure 1:
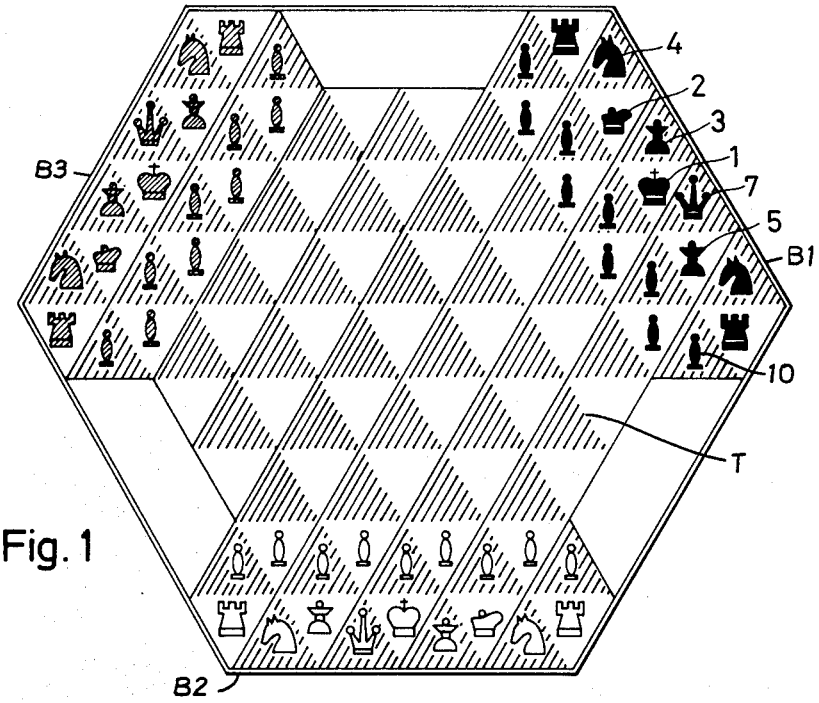
FIG. 1 illustrates a chess board according to the invention, with triangular fields, showing the positioning of three sets of men according to the invention in correspondence with three bases.
Figure 2:
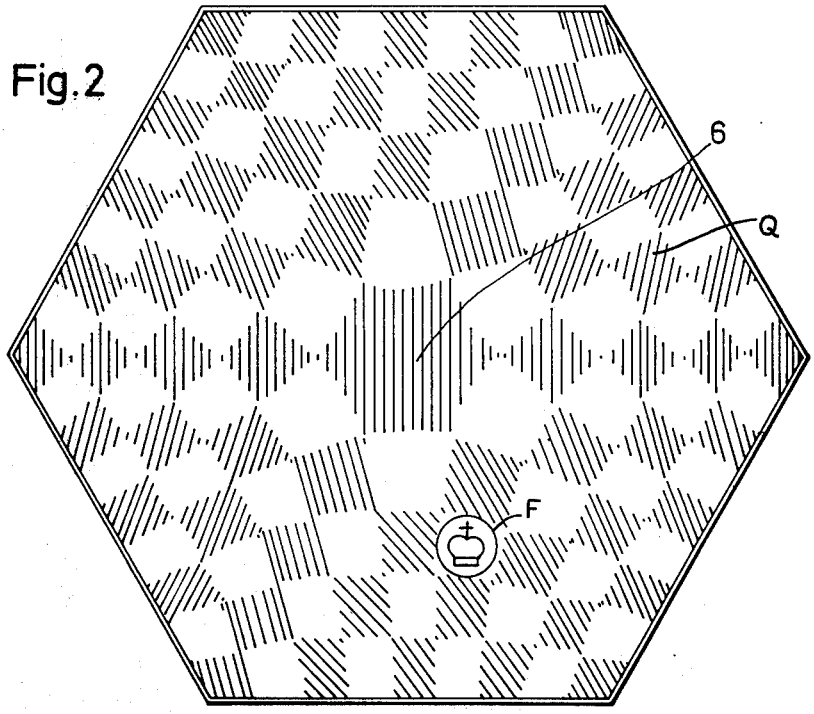
FIG. 2 illustrates a chess board with quadrangular or quadrilateral fields.
Figure 3:
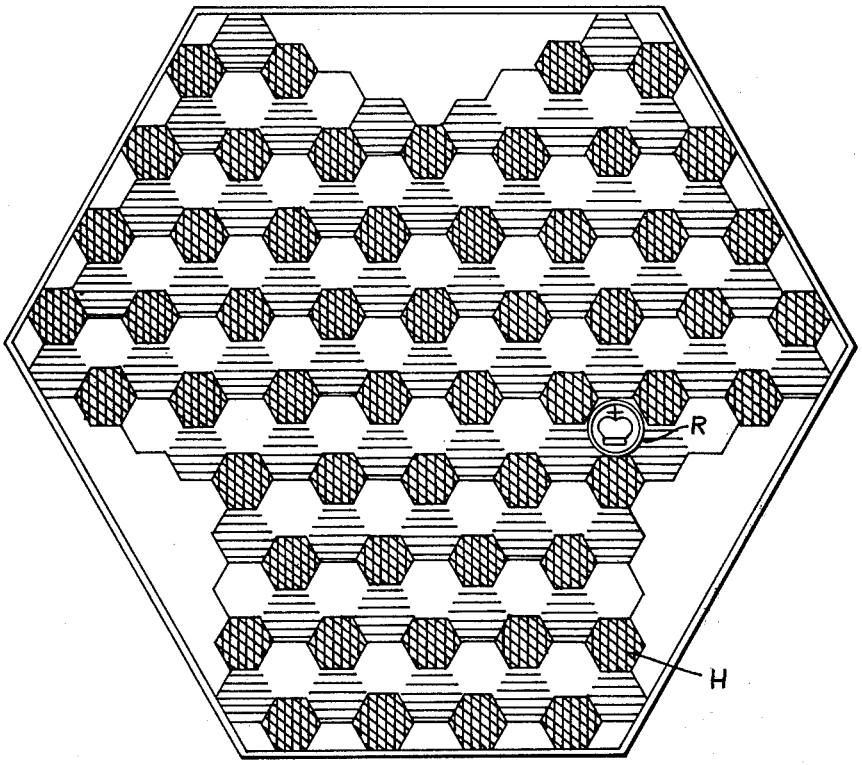
FIG. 3 illustrates a chess board with hexagonal fields.

With the adding of the cardinal and another of the known chess men (e.g., a pawn) according to the invention, the board consists of triangular, quadrangular or hexagonal fields as shown in FIGS. 1, 2 and 3. This has the advantage that all of the chess men can move on all fields, according to the same rules which are adapted to cover the additional movement lines in the triangular or hexagonal fields, like in two-man chess. Moreover, there are identical winning chances for each party and each chess man.

A further feature of the invention is that the checkmating of the king becomes a historical event, as it can be freed from the checkmate. According to the invention, the king is under only a limited checkmate to the mutual ending of the game and it is given a mark such as, e.g., it is set on a field of different color inserted under it or a ring is placed around it.

In FIG. 1 is shown a chess board according to the invention, with triangular fields T relative to which are illustrated the starting positions of the three participants. The king 1 is placed at the center and the cardinal 2 is set, for example, between the bishop 3 and the knight 4, so that there are, as in the known game, one bishop 3 on the dark field and one bishop 5 on the light field. There is one extra pawn 10 and three complete sets of pieces are set up at bases B1, B2 and B3. Therein it can be seen that each set comprises nine pawns and nine other pieces or officers consisting of eight conventional officers and the cardinal 2.

In FIG. 2 is shown a chess board with quadrangular fields Q. For the hexagonal field 6 at the center of the board, the same rules of movement as in the two-man game are analogously applied to the additional movement lines of the hexagon.

In FIG. 3 is shown a chess board with hexagonal fields H.

Figure 4:
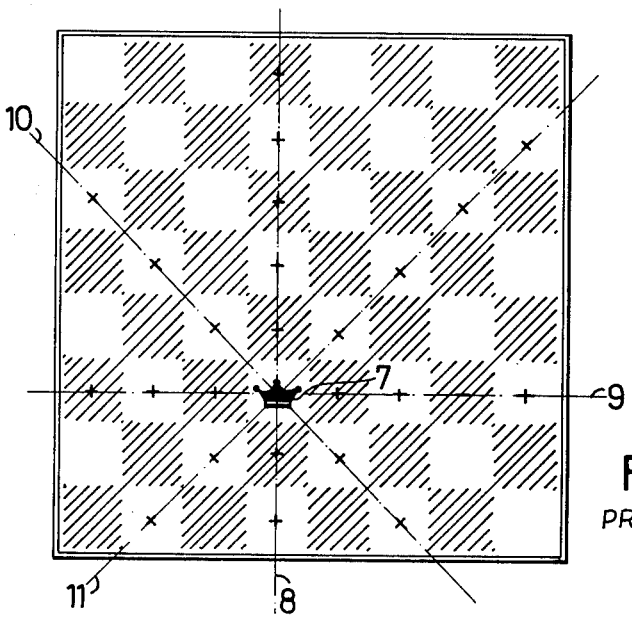
Fig.4 PRIOR ART
FIG. 4 illustrates a chess board of the prior art, and illustrates the movement lines of a queen.

In FIG. 4 are shown the movement lines of a queen 7, in a known two-man chess game, starting from a light field. The queen moves vertically along a "line" 8 or horizontally in a "row" 9 or along one of the two "diagonals" 10 or 11.

Figure 5:
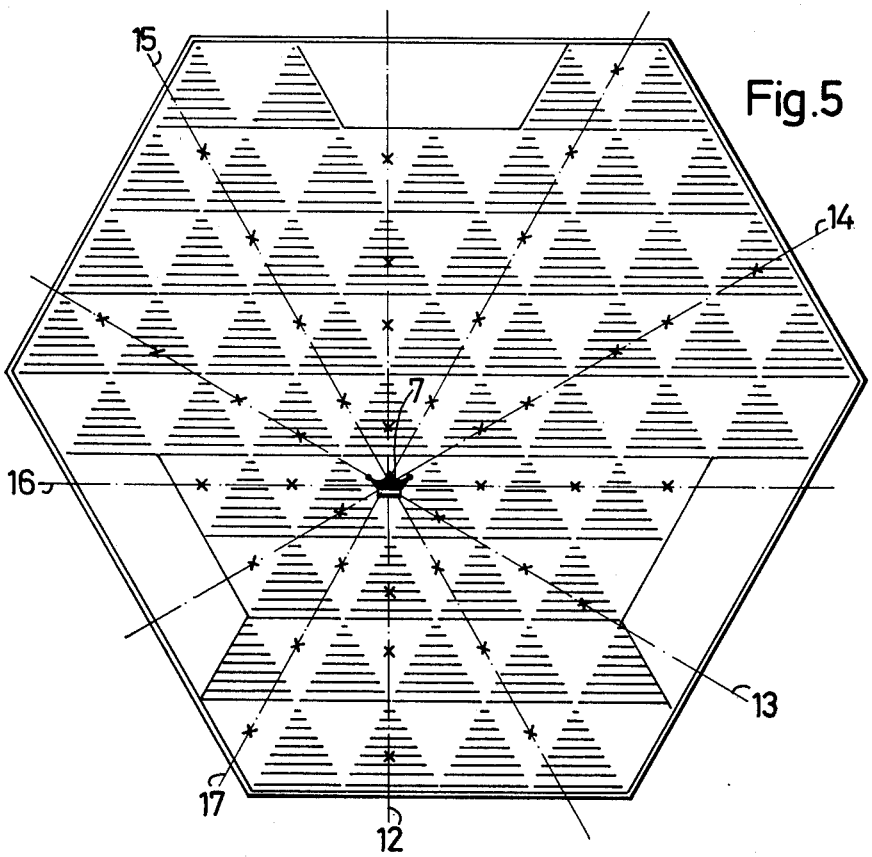
FIG. 5 illustrates a chess board of the invention and the movement lines of a queen thereupon.

In FIG. 5 are shown the movement lines of the queen 7 on a board, according to the invention, with triangular fields, starting from a light field. In this arrangement, the queen moves on one of the three "direct" lines 12,13, or 14, in conformity with 8 or 9 on quadrangular fields, or it moves on one of three "indirect" lines 15,16 or 17, in conformity with 10 or 11 on quadrangular fields.

The board, according to the invention, with triangular fields has the immediately recognizable advantage that the degree of liberty of movement, with Fr. = L/S = 6/3 = 2, is again the same as in the known two-man chess game.

Chess for three people, according to the invention, is thus played on a chess board with triangular fields and an equal or varied number of known chess men from the known two-man chess game for each party, and is distinguished by the fact that each of three participants has at its disposal at least one additional chess man, i.e., the cardinal, which has social-political status which results from the combination of one or more of the following qualities: the quality of game preservation in that a participant whose king has been checkmated can continue to move with this man, the quality of protection as this chess man can be conquered only under difficult circumstances or not at all, the quality of political fight without use of force as this chess man cannot conquer, and the quality of fast, tactical movement as it moves like a queen. More specifically, the cardinal has the following significance in the three-man chess game.

The cardinal can move in the following manner:

1. He moves like the queen but he may not conquer men from sets of other participants.
2. He can be conquered only when he is attacked simultaneously by figures from both other participants.
3. The figure conquering the cardinal must quit the game; that means this figure is a victim of its successful attack against the cardinal.
4. The cardinal may move instead of his checkmated king. In this case, the king and all other figures of this party can not move until the cardinal is able to move between his king and the figure checkmating him.

It will be noted that the cardinal can move not only if his king is checkmated but also during the whole game.

Chess according to the invention may also be characterized by adding more of the known chess men (e.g., pawns) and is further distinguished by the use of a chess board consisting of triangular, fields as illustrated in FIG. 1.

Chess according to the invention is also distinguished by the use of a king subject to capture under only limited checkmate until the mutual ending of the game and marked with, for instance, a field of different color inserted under it such as indicated at F in FIG. 2 or a ring around it such as indicated at R in FIG. 3.

What is claimed is:

1. A chess game for three persons comprising means having a hexagonal playing surface with three shorter and three intermediate, alternating longer sides, said surface being divided into triangular playing fields of two alternate colors, three sets of chessmen including pawns and officers, the length of the shorter sides of the playing surface being four times the lateral length of the triangular playing fields and serving as ground-lines for the three players, the length of said longer sides being five times the lateral length of the triangular playing fields, there being blank portions without triangular playing fields along said longer sides so that the playing surface consists of one-hundred and six playing fields, each set of chessmen including nine of said officers and nine of said pawns, eight officers being the same as in conventional chess and the ninth officer having a shape that is different from all other of said chessmen.

2. A chess game as claimed in claim 1 comprising an identifying field to set under a checkmated king.

3. A chess game as claimed in claim 1 comprising an identifying ring to encircle a checkmated king.

4. A chess game as claimed in claim 1 wherein each set of chessmen includes an element adapted for being assigned to a king and to signal a time determined mate position.

5. A chess game as claimed in claim 4 wherein said element is a ring that can be hung about the king.

* * * * *